US006146117A

United States Patent [19]

Miura et al.

[11] Patent Number: 6,146,117

[45] Date of Patent: Nov. 14, 2000

[54] SCROLL HYDRAULIC MACHINE

[75] Inventors: Shigeki Miura, Nishi-kasugai-gun; Makoto Takeuchi, Nagoya, both of Japan

[73] Assignee: Mitsubishi Heavy Industries, Ltd., Tokyo, Japan

[21] Appl. No.: 09/008,834

[22] Filed: Jan. 20, 1998

[30] Foreign Application Priority Data

Jan. 24, 1997 [JP] Japan ..... 9-024466

[51] Int. Cl.[7] ..... F04C 18/00

[52] U.S. Cl. ..... 418/55.3

[58] Field of Search ..... 418/55.3

[56] References Cited

U.S. PATENT DOCUMENTS

| | | | |
|---|---|---|---|
| 5,275,543 | 1/1994 | Tamaka et al. | 418/55.3 |
| 5,569,028 | 10/1996 | Yamamura et al. | 418/55.3 |

FOREIGN PATENT DOCUMENTS

| | | | |
|---|---|---|---|
| 37728 | 4/1981 | European Pat. Off. | 418/55.3 |
| 0012003 | 1/1989 | Japan | 418/55.3 |
| 0053084 | 3/1989 | Japan | 418/55.3 |
| 02283882 | 4/1989 | Japan . | |
| 0169885 | 6/1990 | Japan | 418/55.3 |
| 404179885 | 6/1992 | Japan | 418/55.3 |
| 405231348 | 9/1993 | Japan | 418/55.3 |

*Primary Examiner*—Thomas Denion
*Assistant Examiner*—Theresa Trieu
*Attorney, Agent, or Firm*—Oblon, Spivak, McClelland, Maier & Neustadt, P.C.

[57] ABSTRACT

A scroll hydraulic machine which can prevent a key groove of an aluminum front case from being abnormally abraded even when lubricating oil runs out, and which can reduce the number of parts, is provided. The scroll hydraulic machine includes a fixed scroll, a swirling scroll performing a revolutionary swirling motion while engaging with the fixed scroll, an Oldham joint having a key for causing a swirling scroll to move in a revolutionary swirling motion while preventing the swirling scroll from rotating a front case, and a case body receiving the fixed scroll, The swirling scroll and the Oldham joint are positioned within a housing formed by attaching the front case to an opening portion of an end thereof. A key groove portion to which the key of the Oldham joint is fitted and a portion supporting a thrust force acted on the swirling scroll of the front case are made of a ferrous alloy.

2 Claims, 2 Drawing Sheets

SCROLL HYDRAULIC MACHINE

BACKGROUND OF THE INVENTION

1. Field of the Invention

The present invention relates to a scroll hydraulic machine used as a compressor or an expansion device. The present application is based on Japanese Patent Application No. 9-24466, the contents of which are herein incorporated by reference.

2. Description of Related Art

To a hydraulic machine having a fixed scroll and a swirling scroll engaging with the fixed scroll and performing a swirling motion, there is provided an Oldham joint making the swirling scroll perform a revolutionary swirling motion while preventing the swirling scroll from rotating. The fixed scroll, the swirling scroll and the Oldham joint, together with the other parts, are disposed within a housing formed by a case body and a front case attached to an opening of an end thereof.

A vertical cross section of the conventional front case is shown in FIG. 3, in which an Oldham joint and a front case 6 are connected to each other by a key formed in the Oldham joint and a key groove 50 penetrating the front case 6. Further, a thrust bearing 36 supporting a thrust force acting on the swirling scroll is disposed at a peripheral edge of the inner end surface of the front case 6.

In the conventional scroll hydraulic machine described above, for the purpose of reducing weight and making it light, the case body, the front case, the fixed scroll, and the swirling scroll have been normally made of an aluminum alloy.

However, since the Oldham joint is formed of a ferrous alloy and the surface thereof is hardened by a heat treatment, there has been a problem in that, when lubricating oil runs out, the key groove 50 in the front case 6 is abnormally abraded. Further, since it is necessary to provide the thrust bearing, there has been a problem in that the number of the parts is increased, the increasing cost.

SUMMARY OF THE INVENTION

Accordingly, it is an object of the present invention is provide a scroll hydraulic machine which is structured so as to prevent a key groove of a front case from being abnormally abraded, even when lubricating oil runs out, and in which the number of parts can be reduced.

In accordance with the present invention, there is provided a scroll hydraulic machine comprising a fixed scroll, a swirling scroll performing a revolutionary swirling motion while engaging with the fixed scroll, an Oldham joint having a key for causing the swirling scroll to perform a revolutionary swirling motion while preventing the swirling scroll from rotating, a front case constructed such that a key groove portion to which the key of the Oldham joint is fitted and a portion supporting a thrust force acting on the swirling scroll are made of a ferrous alloy, and a case body housing the fixed scroll, said swirling scroll and the Oldham joint being positioned within a housing formed by attaching the front case to an opening portion of an end thereof.

In accordance with the present invention, since the key groove portion to which the key of the Oldham joint is fitted and the portion supporting the thrust force acting on the swirling scroll of the front case are made of a ferrous alloy, lubricating oil in the key groove is well-maintained, and further, even when the lubricating oil slightly runs out, abnormal abrasion is not generated. Further, since the thrust bearing can be omitted, the number of the parts can be reduced and costs can thereby be decreased.

In accordance with the present invention, the structure can be made such that the key groove portion and the portion supporting the thrust force acting on the swirling scroll are separately constituted so as to be integrally connected to the front case through a fastening device. In this case, cost can be further reduced.

DESCRIPTION OF THE PREFERRED EMBODIMENTS

The present invention will be described below on the basis of two preferred embodiments.

Figure 1:
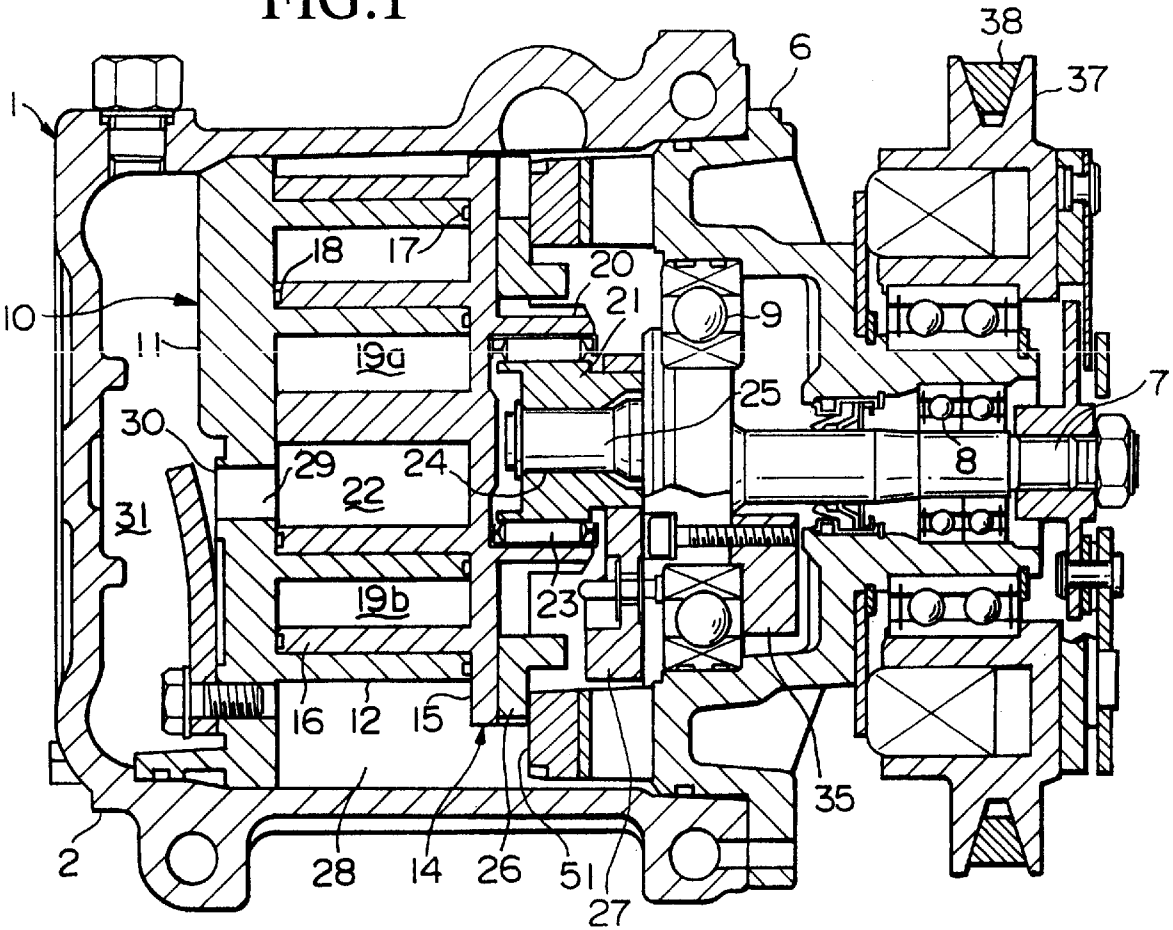
FIG. 1 is a vertical cross sectional view which shows a scroll compressor in accordance with an embodiment of the present invention.
Figure 2:
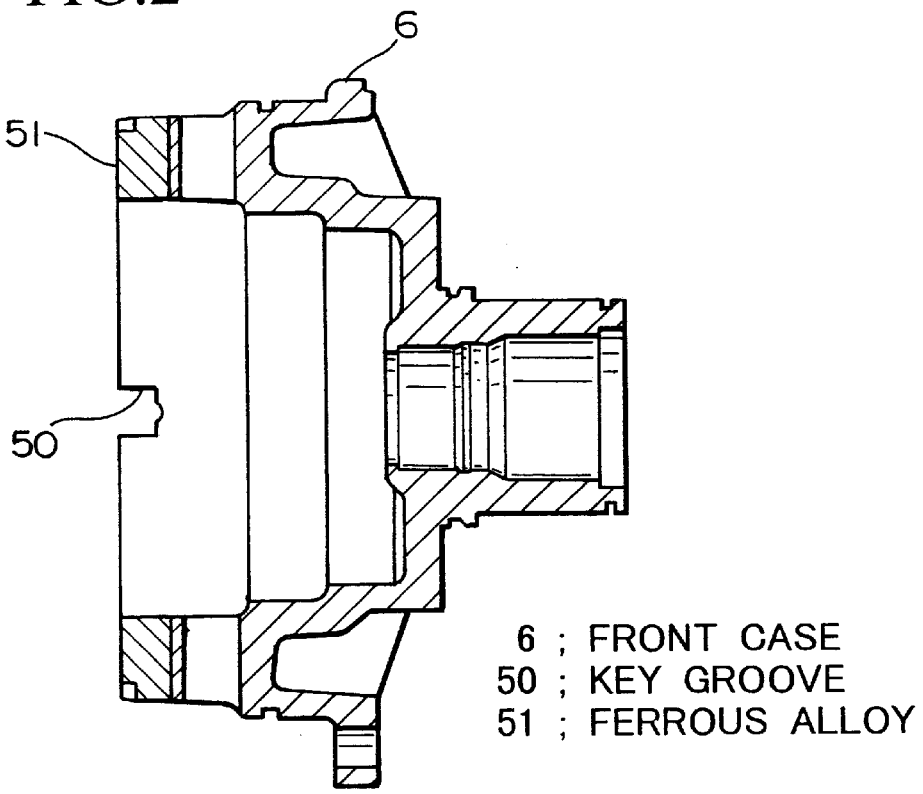
FIG. 2 is a vertical cross sectional view which shows a front case of the scroll compressor in accordance with an embodiment of the present invention.
Figure 3:
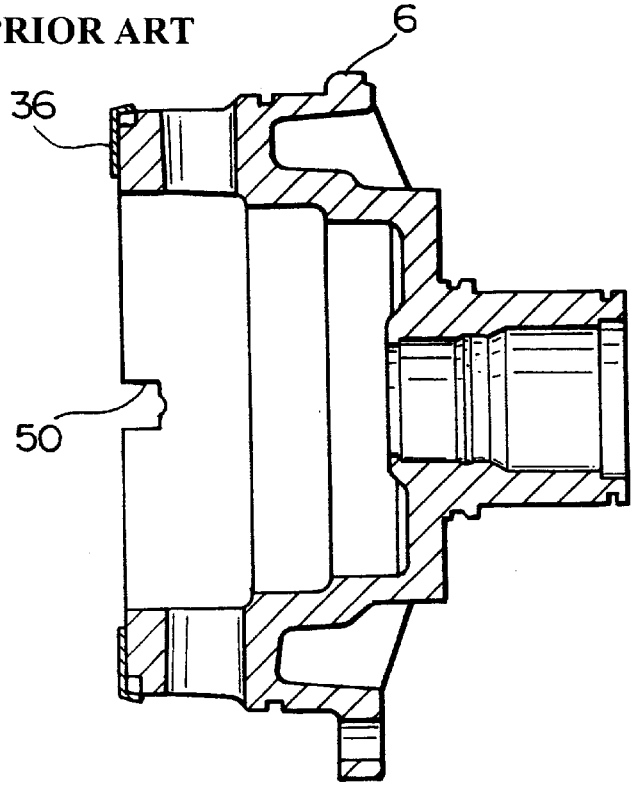
FIG.3 PRIOR ART
FIG. 3 is a vertical cross sectional view which shows a front case of a conventional scroll compressor.

FIG. 1 is a vertical cross sectional view of a scroll compressor in accordance with the a first embodiment and FIG. 2 is a vertical cross sectional view of a front case in accordance with a second embodiment.

In FIG. 1, a housing 1 has a case body 2 and a front case 6 attached to an opening of an end thereof.

A rotating shaft 7 extending through the front case 6 is rotatably supported in the housing 1 via a bearing 8 and a bearing 9.

A fixed scroll 10 and a swirling scroll 14 fitted to each other are disposed within the housing 1.

The fixed scroll 10 is provided with an end plate 11 and a spiral wrap 12 disposed in an inner surface thereof in a standing manner, and the end plate 11 is fastened to the case body 2 by a bolt (not shown).

A space within the housing 1 is separated by bringing an outer peripheral surface of the end plate 11 into contact with an inner peripheral surface of the case body 2, so that a high pressure chamber 31 is formed in an outer side of the end plate 11 and a low pressure chamber 28 is formed in an inner side of the end plate 11.

Further, a discharge port 29 penetrates a center of the end plate 11, and the discharge port 29 is structured in such a manner as to be opened and closed by a discharge valve 30.

The swirling scroll 14 is provided with an end plate 15 and a spiral wrap 16 disposed in an inner surface thereof in a standing manner, The spiral wrap 16 has substantially the same shape as that of the spiral wrap 12 of the fixed scroll 10.

When the swirling scroll 14 and the fixed scroll 10 are engaged with each other in such a manner as shown in the drawing in a state that the centers thereof are eccentrically shifted at a degree of a first swirling radius with respect to each other and the angles thereof are 180 degrees eccentrically shifted, a tip seal 17 buried on a second front end surface of the spiral wrap 12 is in close contact with the inner surface of the end plate 15, and a tip seal 18 embedded in a front end surface of the spiral wrap 16 is in close contact with the inner surface of the end plate 11, so that the side surfaces of the spiral wraps 12 and 16 are in line contact at a plurality of portions, whereby a plurality of compressing chambers 19*a* and 19*b* forming a point of symmetry with respect to the center of the spiral are formed.

A drive bush 21 is rotatably fitted to an inner portion of a cylindrical boss 20 provided in a center portion on the outer surface of the end plate 15 in a projecting manner through a swirling bearing 23, and an eccentrically shifted drive pin 25 is provided in the inner end of the rotating shaft 7 in such a manner as to have an eccentrically shifted center slidably fitted within a slide groove 24 penetrating the drive bush 21.

Then, a balance weight 27 for balancing a dynamic imbalance due to a swirling motion of the swirling scroll 14 is mounted to the drive bush 21.

In 'this case, an Oldham joint 26 is made of a ferrous sintered alloy(JIS Z 2550 SMF5 containing 0.2/0.8 wt. %Mo), in which a key thereof is fitted into a key groove pierced in the peripheral edge of the outer surface of the end plate 15 and the peripheral edge of the inner surface of the front case 6 so as to oscillate and slide, thereby allowing a swirling motion of the swirling scroll 14 but preventing rotation thereof.

A balance weight 35 is fixed to the rotating shaft 7 and a relief valve 30 opens when a gas pressure within the high pressure chamber 31 increases abnormally.

Accordingly, power from an automotive engine (not shown) is transmitted to the rotating shaft 7 through a belt 38 and a electromagnetic clutch 37 by using the electromagnetic clutch 37 as a contact.

When the shaft 7 is rotated, the swirling scroll 14 is driven through a revolutionary swirling drive mechanism also serving as a swirling radius changing mechanism comprising the eccentrically shifted drive pin 25, the slide groove 24, the drive bush 21, the swirling bearing 23, and the boss 20, so that the swirling scroll 14 performs a revolutionary swirling motion on a circular track having a swirling radius of the eccentrically shifted amount between the rotating shaft 7 and the eccentrically shifted drive pin 25 around a line passing through an axial center of the rotating shaft 7 while the rotation thereof is prevented by the Oldham joint 26.

Then, the line contact portion between the side surfaces of the spiral wraps 12 and 16 gradually moves to a center direction of the spiral, and as a result of this movement, the compression chambers 19*a* and 19*b* move to the center direction of the spiral while reducing the volume thereof.

In correspondence to this movement, the gas flown into the low pressure chamber 28 from a suction port (not shown) is introduced into the respective compression chambers 19*a* and 19*b* from an opening portion formed in the outer peripheral ends of the spiral wraps 12 and 16, is fed to a center chamber 22 while being compressed, is discharged to the high pressure chamber 31 from here through the discharge port 29 by pressing and opening the discharge valve 30, and next is flowed out through a discharge pipe (not shown).

When the swirling scroll 14 is driven in a swirling motion, the centrifugal force toward the eccentrically shifted direction and the gas pressure due to the compression gas within the respective compression chambers 19*a* and 19*b* act on the swirling scroll 14, so that the swirling scroll 14 is pressed in the direction in which the swirling radius thereof increases due to the combined force thereof and the side surface of the spiral wrap 16 is in close contact with the side surface of the spiral wrap 12 of the fixed scroll 10 so as to prevent the gas within the compression chambers 19*a* and 19*b* from leaking.

Then, when the side surface of the spiral wrap 12 and the side surface of the spiral wrap 16 slide in a state of being in close contact with each other, the swirling radius of the swirling scroll 14 automatically changes, so that the eccentrically shifted drive pin 25 slides within the slide groove 24.

The front case 6 is made of an aluminum alloy (JIS ADC12), and the inner end portion thereof, that is, at least the key groove portion 50 to which the key of the Oldham joint 26 is fitted and the supporting portion 51 for the thrust force acted on the swirling scroll 14, is made of a casting ferrous alloy, as shown in FIG. 2. An acceptable casting ferrous alloy for this purpose is JIS FC or FCD having HB 200~250 and 200N/mm2 or more tensile strength. They are integrally formed with the front case 6 by an insert, welding or the like.

In this supporting case, this portion 51 can be constructed of a separate part and can be fastened to the front case 6 through a fastener such as a bolt or the like (not shown).

In this case, since the key groove portion 50, to which the key of the Oldham joint 26 is fitted and slides in an oscillating manner, maintains oil therein and is made of a ferrous alloy having a high hardness, even when the lubricating oil slightly runs out, abnormal abrasion is not generated.

Further, since the portion 51 supporting the thrust force by being brought into contact with the peripheral edge of the outer end surface of the end plate 15 of the swirling scroll 14 is also made of an iron material having a good anti-abrasion performance, the thrust bearing 36 can be omitted, as shown in FIG. 2, so that the number of parts can be thereby reduced, and the cost may also be decreased.

In accordance with the present invention, since at least the key groove portion 50 to which the key of the Oldham joint 26 is fitted and the portion 51 supporting a thrust force acted on the swirling scroll 14 of the front case 6 are made of a ferrous alloy, the key groove maintains the oil and, even when the lubricating oil slightly runs out, abnormal abrasion does not occur.

Further, since the thrust bearing 36 of the prior art can be omitted, the number of the parts can also be reduced and the cost therefor can be decreased.

When the key groove portion 50 and the part 51 supporting the thrust force are formed as separate parts and are integrally connected to the front case 6 via the fastener (not shown), the cost can be further reduced.

What is claimed is:

1. A scroll hydraulic machine comprising:

a fixed scroll;

a swirling scroll performing a revolutionary swirling motion while engaging with the fixed scroll;

an Oldham joint being made of a ferrous alloy and having a key for causing the swirling scroll to move in a revolutionary swirling motion while preventing the swirling scroll from rotating;

an aluminum front case structured such that a key groove portion to which the key of the Oldham joint is fitted and a portion supporting a thrust force acting on the swirling scroll are made of a ferrous alloy so that, even when lubricating oil slightly runs out, abnormal abrasion of the key groove does not occur; and a case body for housing the fixed scroll, the swirling scroll, and the Oldham joint within a housing formed by attaching the front case to an opening portion of an end thereof without a thrust bearing located between the front case and the swirling scroll.

2. A scroll hydraulic machine as recited in claim 1, wherein the key groove portion and the portion supporting the thrust force acting on the swirling scroll are separately constituted so as to be integrally connected to the front case.

* * * * *